United States Patent [19]

Johnston

[11] Patent Number: 4,619,095

[45] Date of Patent: Oct. 28, 1986

[54] REVERSIBLE PANEL ARRANGEMENT

[75] Inventor: Kenneth A. Johnston, Mitcham, Australia

[73] Assignee: Kenross Nominees Proprietary Limited, Victoria, Australia

[21] Appl. No.: 810,541

[22] PCT Filed: Oct. 2, 1980

[86] PCT No.: PCT/AU80/00074

§ 371 Date: May 28, 1981

§ 102(e) Date: May 28, 1981

[87] PCT Pub. No.: WO81/01027

PCT Pub. Date: Apr. 16, 1981

Related U.S. Application Data

[60] Continuation of Ser. No. 620,544, Jun. 18, 1984, abandoned, which is a division of Ser. No. 269,045, May 28, 1981, abandoned.

[30] Foreign Application Priority Data

| | | | |
|---|---|---|---|
| Oct. 2, 1979 | [AU] | Australia | PE0732 |
| Apr. 1, 1980 | [AU] | Australia | PE3150 |
| May 8, 1980 | [AU] | Australia | PE3466 |

[51] Int. Cl.[4] ..... E04C 1/0

[52] U.S. Cl. ..... 52/595; 52/127.7; 52/241; 52/243.1; 49/409

[58] Field of Search ..... 52/36, 64, 122.1, 125.1, 52/127.1, 127.6, 127.7, 235.1, 241, 243.1, 278, 281, 284, 578, 581, 586, 593, 595; 49/409

[56] References Cited

U.S. PATENT DOCUMENTS

| | | | |
|---|---|---|---|
| Re. 23,074 | 1/1949 | Henderson | 52/584 |
| 444,042 | 1/1891 | Brock | 52/578 |
| 1,345,967 | 7/1920 | Smelser | 49/318 |
| 1,889,112 | 11/1932 | Shoemaker | 49/409 |
| 2,679,700 | 6/1954 | Urbain | 52/36 X |
| 3,072,975 | 1/1963 | Burmeister | 49/409 X |
| 3,295,257 | 1/1967 | Douglas | 49/127 |
| 3,295,588 | 1/1967 | Gilson | 49/317 X |
| 3,300,899 | 1/1967 | Hans et al. | 52/64 X |
| 3,309,816 | 3/1967 | Malone, Jr. | 49/127 |
| 3,327,439 | 6/1967 | Eatough | 49/317 X |
| 3,557,499 | 1/1971 | Dickie | 52/36 |
| 3,604,168 | 9/1971 | Meineke | 52/238.1 |
| 3,707,060 | 12/1972 | Jansen, Jr. | 52/241 |
| 3,802,480 | 4/1976 | Daggy | 160/40 |
| 3,803,787 | 4/1974 | Daggy | 52/241 |
| 3,967,420 | 1/1976 | Papsco et al. | 52/122 |
| 4,103,463 | 8/1978 | Dixon | 52/122 |

FOREIGN PATENT DOCUMENTS

| | | | |
|---|---|---|---|
| 2302105 | 8/1973 | Fed. Rep. of Germany . | |
| 2207079 | 8/1973 | Fed. Rep. of Germany | 52/586 |
| 2600080 | 7/1976 | Fed. Rep. of Germany | 52/601 |
| 2613675 | 10/1977 | Fed. Rep. of Germany | 52/282 |
| 497184 | 12/1938 | United Kingdom . | |
| 1449475 | 9/1976 | United Kingdom . | |
| 1470056 | 4/1977 | United Kingdom . | |

*Primary Examiner*—John E. Murtagh
*Assistant Examiner*—Andrew Joseph Rudy
*Attorney, Agent, or Firm*—Cushman, Darby & Cushman

[57] ABSTRACT

An edge mould (36) in the form of an aluminium extrusion, has a male portion (104) and a female portion (106), the latter being defined by at least legs (105, 109). The mould, when attached to a panel edge, enables the panel to be reversible, the male and female portions of abutting moulds mating to locate the two moulds and panels and to provide a sound and drought seal at the join between two panels. The male portion (104) may have a seal (132) in a channel (108) to assist in sealing abutting moulds. Panels using such edge moulds may be used in operable wall systems and in shopfitting systems.

A locking arrangement for a support element, has a lateral channel (192) with a restricted entrance (212), in which a plate (202) is slidable, the plate (202) having a threaded aperture to receive a threaded bolt (210), the shank of which may pass through the entrance (212), an object being able to be removable secured to the channel by being located on the bolt, and the bolt being tightened to clamp channel-defining portions between the plate (202) and the object.

15 Claims, 13 Drawing Figures

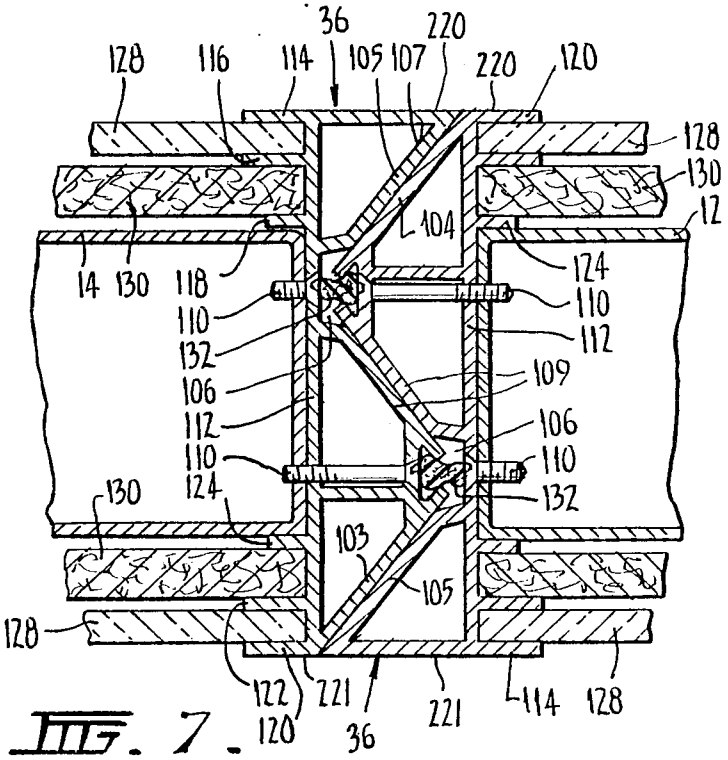
FIG. 7
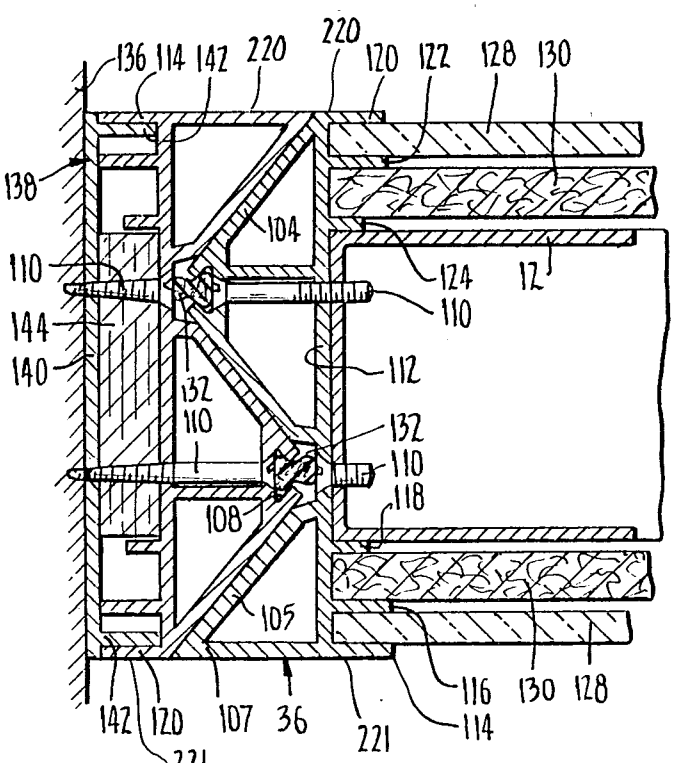

REVERSIBLE PANEL ARRANGEMENT

This is a continuation of application Ser. No. 620,544, filed June 18, 1984 now abandoned and a division of Ser. No. 269,045 filed May 28, 1981 now abandoned.

This invention relates to a reversible panel arrangement. In particular, the invention relates to a reversible operable wall system, and to shopfittings utilizing such an arrangement.

Conventional operable wall systems are not sufficiently flexible in concept to enable them to be used in situations where flexibility is desirable. For example, where an operable wall is used to divide an area into two smaller areas, one side of a partition panel may be provided with a facility such as a blackboard or a projection screen.

Without the ability to reverse the partition so that the facility may be used in both of the small areas, it may be used in only one area, or a facility must be provided on both sides of the panel, at twice the cost. With a reversible panel arrangement the facility may be used in both areas, and a panel may be provided with a different facility on each side for maximum flexibility.

Present partition systems are also costly to produce, largely because they are constructed from a multiplicity of components, the total cost of the fabrication of each, and/or the preparation of tooling or moulds therefor, being very expensive.

In addition, prior art arrangements also lack flexibility by being unable to cope with uneven floor surfaces, so that draughts, and more importantly, sound are able to 'leak' through gaps between the partition panel base and the floor, and between adjacent panels. Furthermore, many systems are locked only at the suspension track supporting the panels, and accidental damage can be caused by movement of panels away from a generally vertical position.

It is an object of this invention to provide an improved reversible panel arrangement.

The invention provides an edge member for a panel arrangement, characterized in that said edge member (36) contains a male portion (104) and a female portion (106) such that it is able to abut a similar edge member (36), the male portion (104) of the edge member being adapted to be received in a female portion (106) of a similar edge member (36), and the female portion (106) of the edge member (36) being adapted to receive the male portion (104) of said similar edge member to locate the edge member and the similar edge member in an abutting relationship.

The invention also provides a reversible panel arrangement using panels fitted with such a mould, and having a sealing/clamping arrangement to lock panels in place.

The invention also relates to a shopfitting arrangement using such panels.

Embodiments of the invention will be described in detail hereinafter, with reference to the accompanying drawings, in which:

FIG. 1 a side elevation of the frame of a first embodiment of an operable wall panel according to the invention:

Figure 2:
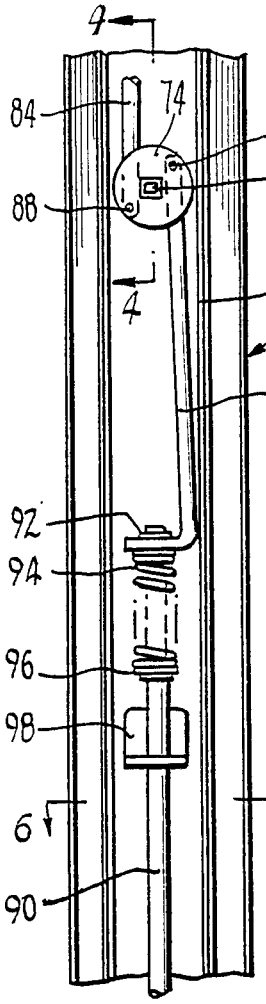
FIG. 2 is a sectional view along the lines 2—2 of FIG. 1.
Figure 6:
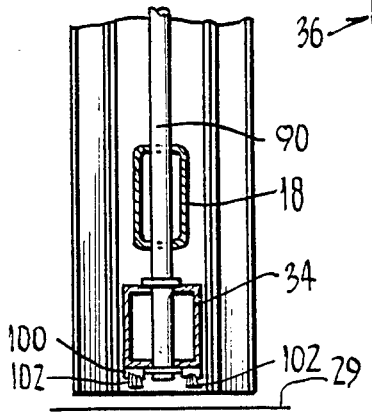
Figure 6:
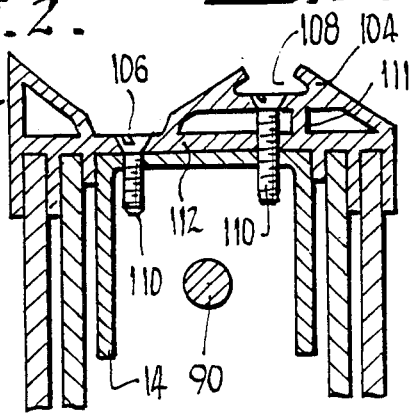
Figure 4:
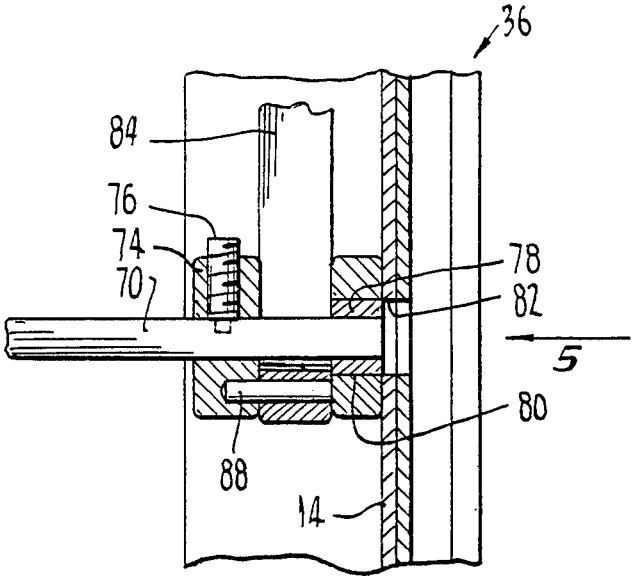
FIG. 4 is a sectional view along the lines 4—4 of FIG. 2.
Figure 5:
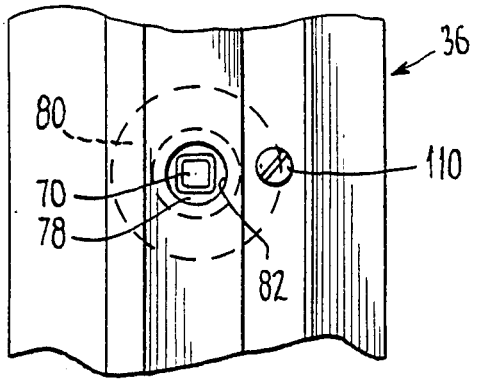
Figure 8:
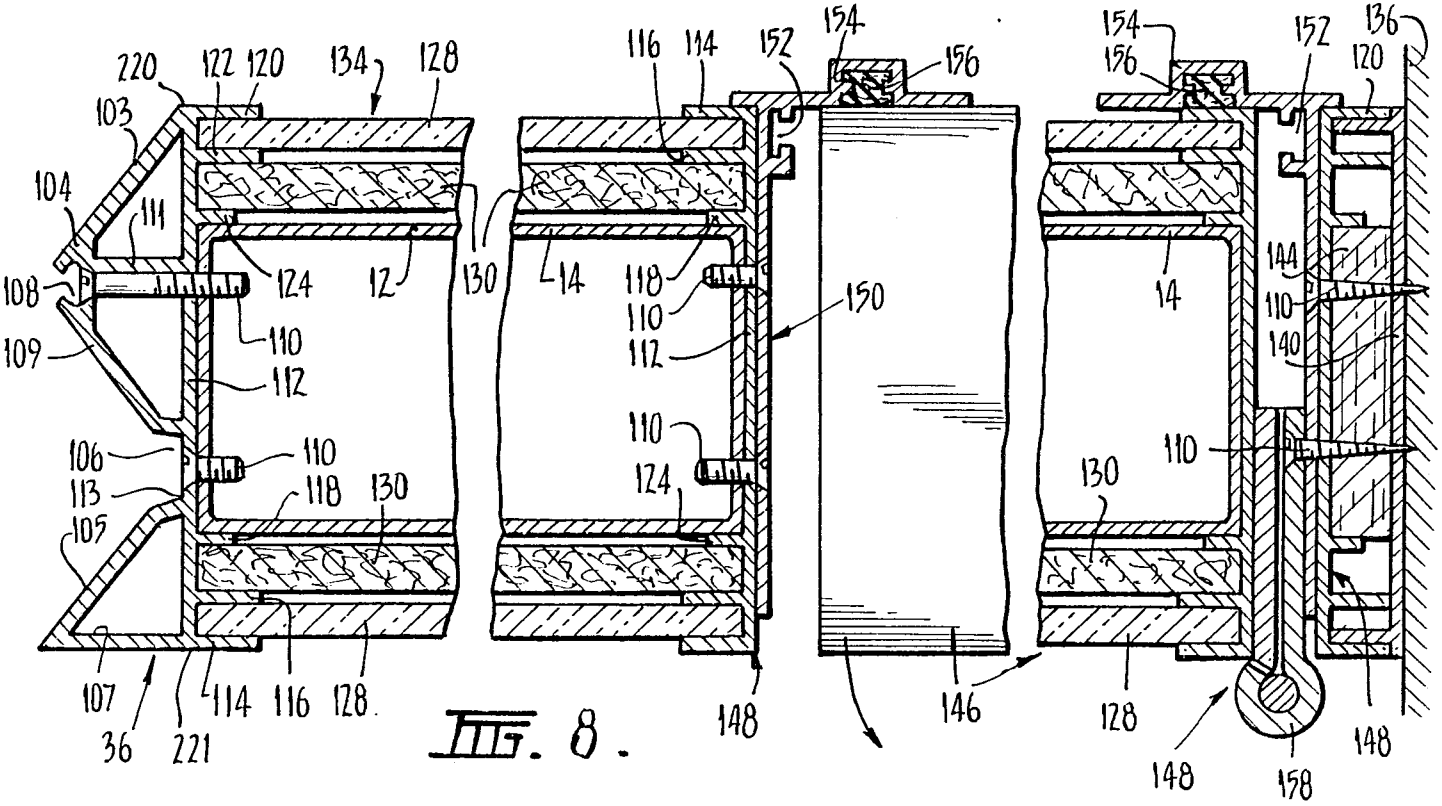
Figures 9, 10, 11:
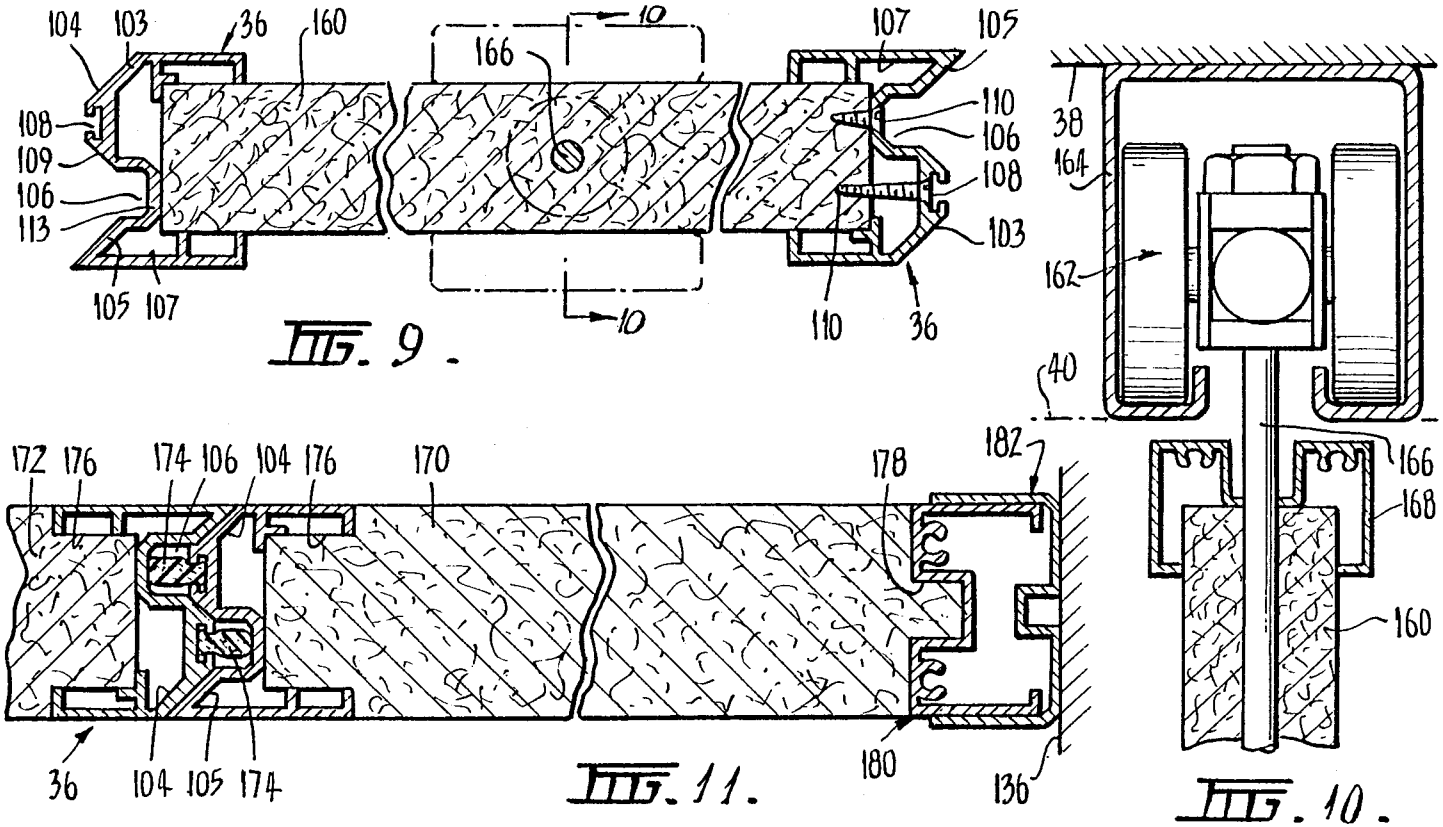
Figure 12:
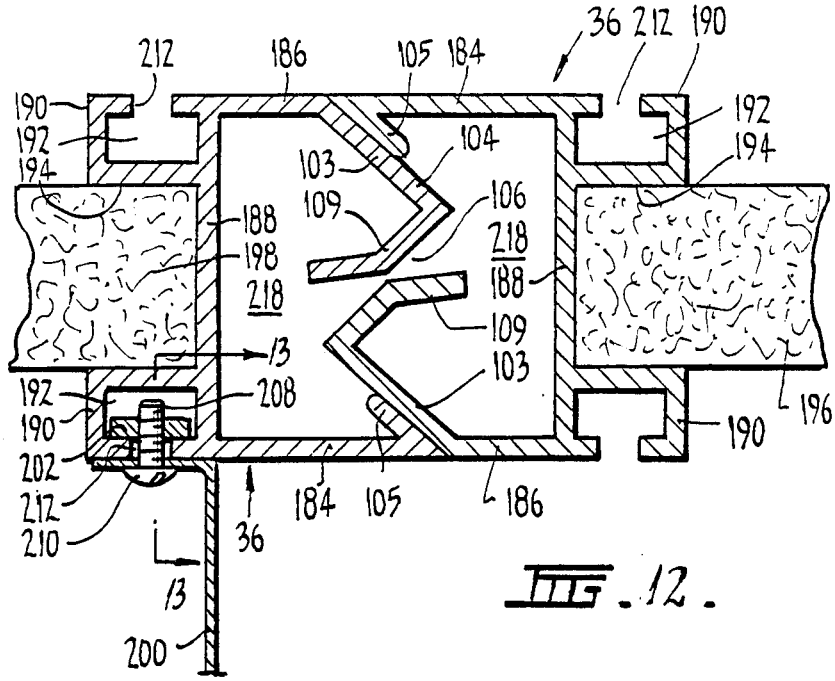

FIG. 5 view, from the direction of arrow 5, of the view of FIG. 4;

FIG. 6 is a sectional view, along the lines 6—6 of FIG. 2;

FIG. 7 is a cross section through two adjacent panels and a right angle intersection of a panel with a fixed wall;

FIG. 8 is a sectional view through a panel arrangement similar to that of FIG. 7, but including a door;

FIG. 9 is a horizontal section through a second embodiment of a wall panel in accordance with the invention;

FIG. 10 is a section along the lines 10—10 of FIG. 9;

FIG. 11 is a horizontal section through two modified panels of the type shown in FIG. 9;

FIG. 12 is a section through two abutting shopfitting panels; and

Figure 13:
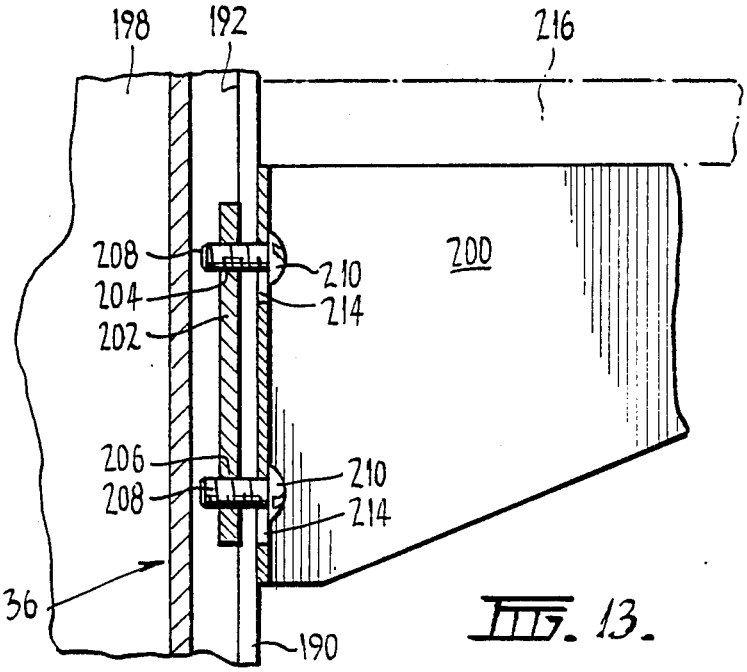

FIG. 13 is a view along the lines 13—13 of FIG. 12.

Figure 1:
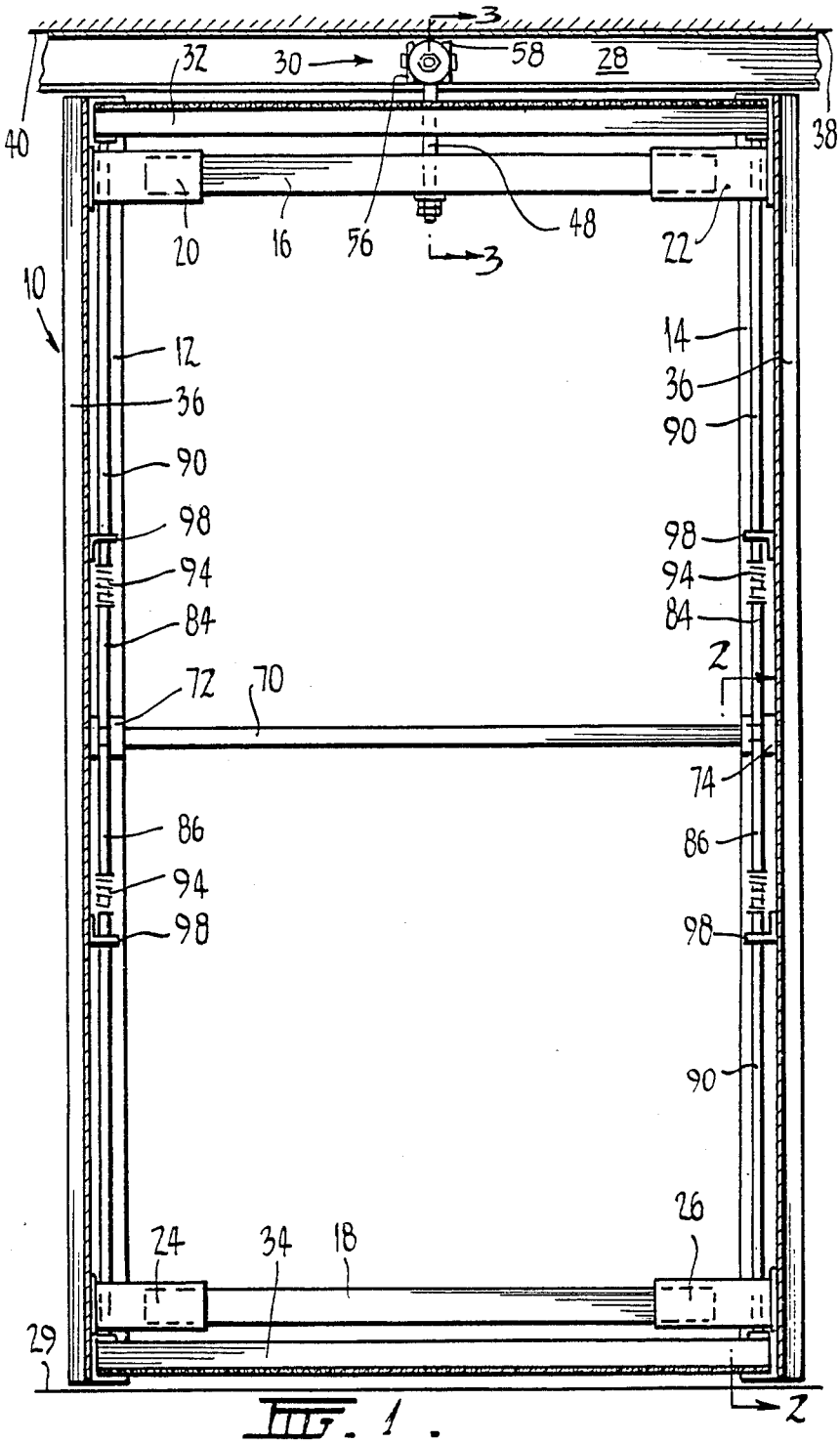

Dealing firstly with FIGS. 1 to 5, there is shown in FIG. 1 a panel frame 10, which is actually a full panel minus the panelling sheets. The frame 10 consists of main members 12, 14, connected by rectangular-section hollow cross-members 16, 18 which are secured within tubular intermediate brackets 20, 22, 24, 26 which are in turn secured to members 12, 14. Preferably, the frame elements are steel, and are connected by welding, and it can be seen that they may be assembled on site, and that some variation in width is possible by positioning the cross-members relative to the brackets 20, 22, 24, 26.

Figure 3:
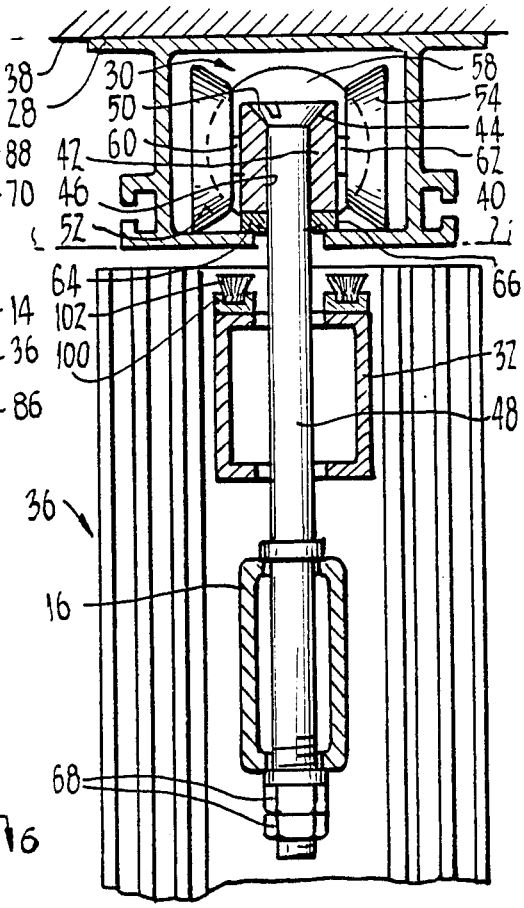
FIG. 3 is a sectional view along the lines 3—3 of FIG. 1.

The frame 10 is, in use, suspended from an overhead track 28 by a trolley 30 in a manner shown in more detail in FIG. 3. Upper and lower sealing elements 32, 34 form part of a locking system, to be described in detail hereinafter, to lock panels against both ceiling and floor. Finally, the panel has reversible edge mouldings 36, which are shown in more detail in the later Figures.

In FIG. 3, the overhead track 28 is shown, secured to a ceiling or portion of a ceiling or the like 38. The actual ceiling line is shown as 40. The trolley 30 comprises a generally cuboidal body portion 42 which has a curved-sided frusto-conical recess 44 therein, which communicates with a co-axial bore 46 which extends through the body portion 42. The recess and bore arrangement is adapted to receive a bolt 48 fitted with a complementary curved-sided frusto-conical annulus or head 50.

Four wheels 52, 54, 56 and 58 are located on each of the four sided faces of the body, each of which wheels are adapted for rotation about an axle, two of which are shown in FIG. 3 under the reference numerals 60 and 62. The axles may be in the form of threaded bolts which engage with an internal thread in a bore in the body 42 and although not shown preferably support in some way a ball race between the axle and the wheel in question.

Two generally parallel shoes 64 and 66 are fixed to the base of body 42 by means of screws, bolts or the like. The lowermost faces of the shoes are in a plane which is slightly above the plane formed by the lowermost portions of the four wheels.

The trolley arrangement of FIG. 3 operates at an intersection between overhead tracks, in this case a right angle intersection, as follows. If we consider that wheels 52 and 54 are those in contact with the overhead track and thus rotating it would be evident that when the arrangement reaches the intersecting track that portions of the wheels will enter the slot of the intersecting track.

Shoes 64 and 66 therefore act to minimize the falling of the wheels into the track by resting across the slot of the initial overhead track. From this position it is easy to move the arrangement along the initial track on the pair of wheels 52 and 54 or along the intersecting track using the wheel pair 56, 58.

The bolt 48 passes through apertures in sealing element 32, and in members 16, and is secured against member 16 by nuts 68. The panel frame 10 is rotatable about the axis of bolt 48, either by the bolt being able to rotate relative to the trolley, or by the panel frame being rotatable relative to the bolt. It should be mentioned here that other forms of trolley may be used with the panel arrangement of this invention, although one which allows movement in more than one direction is preferred.

The panel locking means includes a square-section hollow member 70 to which are secured two cylindrical members 72, 74. Each member 72, 74 is secured to member 70 by a grub screw, one of which is shown as 76 in FIG. 4. The ends of the member 70 are supported in a bearing arrangement by frame members 12, 14, as also shown in FIG. 4, although that is only one possible form. A flattened cylindrical intermediate member 78 has a square aperture to receive member 70, and itself rotates within an annular bearing 80 which is secured to (in this case) member 14. An aperture 82 is provided in member 14 (and in the corresponding position in member 12) for the insertion of a carriage key or the like to rotate member 70. This is best shown in FIG. 5.

Rotatably mounted on cylinder 74 by pins 88 are the ends of two L-shaped levers 84, 86. Lever 86 will be described here, although the other four in a panel frame of the type shown operate in a similar fashion.

The remote end of lever 86 is apertured, and receives through the aperture a rod 90 which has a cap 92 preventing it from moving out of the aperture, although limited movement of the rod is possible, relative to the lever, against the force of a strong coil spring 94, which is held between lever 86 and an annular abutment 96 on rod 90. The rod passes through guides 98, and through members 18, and 34, and is rigidly connected to member 34. Members 32 and 34 (FIGS. 3 and 2 respectively) have twin outer channels 100, in which are located sealing brushes or the like 102. The operation of the locking mechanism will be described hereinafter.

The reversible mould 36 per se is shown in some detail, in section, in FIGS. 6 and 8. The mould is a male/female type, having a V-shaped male portion 104 having legs 103, 109 and a female portion 106. The female portion is defined by leg 105 of V-shaped portion 107, by leg 109 of male portion 104, and by U-shaped channel section 113. The outer leg 103 of the male portion forms an inclined outer planar surface and the outer leg 105 of the female portion 106 forms an inclined outer planar surface. As illustrated, each of the surfaces extend straight to the side walls of the panel. The male portion 104 has a channel 108 located at its tip, in which a sealing member is located. The mould 36 is secured to member 14 (or to member 12) by screws 110 which pass through holes bored in mould 36 at predetermined longitudinal lateral intervals.

Each mould 36 has a main web 112 from which extends, in the opposite direction to the male and female portion, two sets of three ribs 114, 116, 118 and 120, 122, 124 between which panel elements may be located. The mould also includes a strengthening rib 111 joining male portion 104 and web 112.

In FIG. 7, for panel 126, the elements are plywood exterior panelling 128, and sound and fire insulating asbestos panelling 130. Of course, any type of panelling may be used. The panel elements would normally be slid into place, and provision would be made for an abutment at the base of each channel between the various ribs to prevent further movement of the panels elements.

FIG. 7 shows two adjacent panels 128 and 130, where two reversible moulds 36 are in abutment. Each mould has a pair of flat exterior planar surfaces 220, and 221, respectively. It can be seen that the moulds locate the two panel edges together, the male portion 104 of each mould nesting within the female portion 106 of the other. Legs 103 and 109 of one mould abut legs 105 and 109 of the other mould. The abutting moulds provide a barrier to the passage of sound and draughts, even without the use of the seals 132. Even when the two moulds are not in tight abutment, sound waves have to pass along a Z-shaped path, and would be severely attenuated passing from one side of the panels to the other. The moulds of this and the other embodiments of the invention are preferably aluminium extrusions, as are the other strips used in the various embodiments. Part of web 112 could be omitted, and rib 111 could be deleted.

A third mould 36 is seen forming part of a right-angle intersection with a solid wall 136. A backing strip 138 having a web 140 and two ribs 142 to locate ribs 114 and 130 of a mould 36. A filling strip 144 may be used to strengthen the arrangement, and screws 110 may pass through the various components to the wall 136, or some only into the filler. With such an arrangement, a panel 126 provided with an edge mould 36 may be abutted to a solid wall with the same sound/draught sealing characteristics, as exist between two similar panels.

FIG. 8 shows an arrangement similar to that of FIG. 7, except that a door 146 is provided in the panel arrangement. Panel 134 has a mould 36 on one edge, but has a flat mould 148 on the other edge, the flat mould 148 being, in effect, a mould 36 with the male and female portions removed, but having a web 112 and the ribs 114, 116, 118, 120, 122 and 124 which operate the same way as the ribs of a reversible mould 36. A door architrave strip 150 and the mould 148 are secured to member 14 by screws 110 in the same manner as the mould 36 is attached to member 12.

The architrave strip 150 is L-shaped in section, and includes two channels 152, 154 near the intersection of the two legs, for the insertion of seals 156. In the example shown, only channel 154 is provided with a seal. The same architrave strip 150, reversed, is located on the other side of the doorway. It is secured to a solid wall in an arrangement very similar to that described in relation to FIG. 7. The only difference is the use of a flat mould 148 instead of a reversible mould 36, and the attachment of one arm of a hinge 158 through the flat mould and into the filler and possibly the wall. It should be clear that flat mould 148 could be attached to another panel, for a door in the middle of a panel arrangement.

The door 146 may be considered to be identical to a regular panel except flat moulds 148 are used instead of moulds 36, and the door is not suspended. The door frame is constructed exactly the same way as a panel frame 10, and the same types of panel elements may be used to finish it. It will conveniently be the same height as a regular panel, but will preferably be less wide. It contains a locking arrangement similar to the one to be described in relation to panel frame 10, but the arrangement is operated by the door handle, such that when the door 146 is closed, the seals 32, 34 will be extended, and by turning the handle to open the door, the seals will be retracted into the door panel.

Such an arrangement would be ideal for a fire door, and the use of a seal member actuating arrangement, which operates around the periphery of the panel, enables the top half and/or the bottom half of the door to be glazed, unlike prior art doors. Various types of mechanical arrangements could be used to operate the seals on a door, but all such variations are within the scope of the invention.

The door, of course, opens in the direction of the arrow, and when closed abuts seals 156. Details of handles, locks and the like are not shown as they are intended to be conventional.

In use, panels as described are fabricated, hung, and positioned, ready to be locked in place with the sealing arrangement of FIGS. 1 to 5. To lock the panel once it has been positioned, a carriage key is inserted in the end of member 70 shown in FIG. 5. The member is rotated counter-clockwise (clockwise in FIG. 2) which forces levers 84 and 86 upwards and downwards, respectively, and the same occurs with the corresponding levers near the other edge of the panel. Lever 86, by way of example, pushes down rod 90 until seals 102 abut the floor. Further movement of rod 90 simply overrides the force of spring. Similarly, the other rods act to force the seals of sealing members 32, 34 to firmly contact the underside of track 28, and the floor 29 respectively.

Members 70 is rotated to an over-centre position, from which it cannot be moved except by the carriage key. Differential amounts of travel between the ends of the respective sealing members and, in particular, floors which are uneven, are compensated for by the arrangement which allows relative movement between rods and levers against the spring force. This arrangement provides for a complete seal at top and bottom of the panel as well as between abutting edge moulds 36. In the door 'panel' the arrangement is modified so that the action of turning the handle is translated into rotation of a member such as 74. For panels and doors, the sealing mechanism may be operated from the centre of a panel, particularly for the last panel in a wall. Such an arrangement could use a chain running across the panel around sprockets at either end and at the central locking position. The movement of the chain, or the end sprockets, could be translated into rotation of cylindrical members such as 74. The sealing could be operated from both sides of the panel with a carraige key or other device.

The embodiment of FIGS. 1 to 8 is essentially a high-quality, high sound-rated operable wall arrangement with reversible panels and a locking mechanism enabling panels or doors to be glazed.

The embodiment of FIGS. 9 to 11 is, in contrast, a low cost, more basic operable wall system with a capacity for reversibility, using reversible moulds for location of adjacent panels and to permit reversibility.

In FIG. 9, a panel with two reversible moulds 36 is shown. The mould 36 is similar to that of the embodiment of FIGS. 1 to 8, in that it comprises a male portion 104 with a channel 108, and a female portion 106.

The mould 36 is adapted to receive a panel 160, and be secured thereto by screws 110, in a manner similar to that described in relation to the previous embodiment. FIG. 9 shows a simple, rectangular profile panel, which may be wood, chipboard, pyneboard or the like, painted, veneered or otherwise finished.

In FIG. 10, the panel is shown suspended from a prior art trolley 162, which runs in a conventional track 164 attached to a ceiling member 38. The suspension rod 166 of the trolley 162 is connected to the panel in a conventional manner, and the panel has a conventional top mould 168. All moulds of this embodiment are preferably anodized aluminium.

FIG. 11 shows parts of two abutting panels 170, 172, with two moulds 36 in location and abutment, with the male portions 104 nestling in the female portions 106, with seals 174 completing the seal. In this Figure, the panels 170, 172 are rebated (176) to present a smooth appearance. The panel 170 may be similarly worked at the other end (178) to fit within one mould 180 of a terminating arrangement, which also includes a second mould 182, which is attached to a solid wall 136. The thicker panels 170, 172 may be painted, veneered, vinyl-covered, laminated or otherwise finished.

The embodiment of FIGS. 12 and 13 relates to a shopfitting arrangement using reversible panels which have reversible edge moulds 36, which are a third modification of the moulds of the previous embodiments. The moulds contain a male portion 104 and a female portion 106, which are defined by legs 184, 186 extending from a web 188. The legs 184, 186 include leg portions 103, 105 and 109 which operate in the same way as described in previous embodiments. Extending in the opposite direction from the web 188 are two L-shaped arms 190 which form with web 188 and the near end of legs 184, 186, T-section channels 192.

The channel section portion 194 between legs 190 and web 188 is adapted to receive a panel 196, which may be as shown, or may be rebated to provide a flush mounting.

In FIG. 12, two moulds 36 are shown in abutment, representing two adjacent panels 196, 198 in a shop-fitting arrangement, which may be in the form of a counter, a wall mounted arrangement, a floor-mounted arrangement or a gondola arrangement. Adjacent panels may be secured together by screwing or bolting a capping strip to both panels, and may be attached to a support frame, or to a wall, in a conventional manner.

FIGS. 12 and 13 show an arrangement for supporting a shelf bracket 200. A flat cuboidal plate 202 is adapted to be inserted in, and removable from, a channel 192, and can slide along the length of the channel. The plate has two threaded apertures 204, 206, adapted to receive threaded bolts 208 which have a slotted head 210. The shank of the bolts is able to pass through the narrow opening 212 of the channel 192.

Bracket 200 has two keyhole-shaped apertures 214, through which the bolt head 210 can pass, and the bracket may then be dropped down so that the bolt shank seats in the narrow portion of the aperture 214. To secure the bracket to the mould 36, the bolts are merely tightened. It has been found that the effect of tightening is to make the channel, plate and bracket act as a single mass, and is very strong. The bracket 200 may be infinitely adjusted with respect to the mould 36, to support a shelf 216, a desk top, a wire bracket, or any other fitting. Of course, other types of brackets or fittings may be used instead of bracket 200.

In an uncapped arrangement, a bracket/plate arrangement could be slipped into channel 192 from the top (or bottom) of the arrangement, or the plates could be left in the channel, and attached to a bracket or the like when desired.

It should be noted that the internal space 218 in moulds 36 could be used to pass electrical wiring or other similar material therethrough. It is also apparent that the channel/plate/bracket arrangement could be used on a column or strip which was not an edge mould.

Panels 196, 198 are preferably laminated or veneered material, and the moulds 36 and plates 202 are preferably anodized aluminium. The bracket 200 would normally be steel, and the shelf wood or chipboard.

The present invention, although represented here in three embodiments, has many possible adaptations, within the broadly described and defined scope of this application.

I claim:

1. A panel comprising a frame having first and second side walls formed parallel to one another and defining a space therebetween, and an edge member secured to said frame between said first and second sidewalls, said edge member comprising:

first and second flat exterior planar side surfaces formed parallel to one another and defining a space therebetween;

an elongated section having in cross section a first planar flat surface extending from one of said flat exterior planar surfaces of said edge member inwardly into said space and being inclined at an acute angle with respect to said one of said planar side surfaces, a second planar flat surface extending from the other flat exterior planar surface of said edge member inwardly into said space between said surfaces of said edge member and being inclined at an acute angle with respect to said other palnar side surface, one of said first and second planar flat surfaces extending inwardly from its adjoining side surface toward said frame and the other of said planar flat surfaces extending inwardly into said space from its adjoining side surface away from said frame, and a third planar flat surface forming with the planar surface extending away from said frame a male portion and forming with the planar surface extending toward said frame a female portion, said male and female portions engaging corresponding male and female portions of a identical edge member to guide said corresponding planar inclined surfaces into closely abutting relationship.

2. An edge member according to claim 1, wherein the apex of the male portion (104) incorporates a channel (108) in which a seal (132) is located, which seal, when two edge members are in abutment, seals the male portion (104) relative to the female portion (106) of a similar edge member.

3. An edge member according to claim 2, wherein a channel-shaped portion (113) is formed in the base of said female portion (106) within which the seal (132) on a similar edge member is in use located.

4. An edge member according to claim 1, further comprising a plurality of ribs (114, 116, 118, 120, 122, 124) extending from said edge member inwardly of said side walls such that the edges of sheets of material (128, 130) may be retained between adjacent ribs.

5. An edge member according to claim 1, wherein the elongated section comprises a web member (188), the male and female portions (104, 106) being formed on one side of said web member and elongated T-section channels (192) for use in mounting one or more shelf brackets (200) to the edge member being provided on the other side of the web member (188), said channels (192) having each an elongated opening (212) formed in a side surface of the elongated section between an end of the side wall and an end of an L-shaped arm extending from the web member (188) at a point spaced inwardly from the side wall.

6. An edge member according to any one of claim 5 or 1, wherein the elongated section has a hollow internal space (218) and the female member (106) has its planar surfaces converging toward an elongated opening providing access to said hollow internal space.

7. A panel according to claim 1, wherein said panel is suspended from an overhead track (28) by a trolley (30), said trolley (30) including wheel carriage means enabling the trolley to move in at least two directions, the wheeled carriage means being attached to a body (42) provided with an aperture (46) through which panel suspension means (48) pass to enable rotation of said panel through 360° relative to the track, the body (42) being designed to enable limited angular movement of said panel suspension means relative to the body.

8. A panel according to claim 7, wherein the body is a generally cuboidal body (42), each vertical side of said body having a wheel (52, 54, 56, 58) rotatably mounted thereto.

9. A panel according to claim 8, wherein two generally parallel shoes (64, 66) are fixed to the base of the body (42), the lowermost faces of the shoes being in a plane slightly above the plane formed by the lowermost portions of the wheels.

10. A panel according to claim 9, further comprising a locking means including an actuating member (70) rotatably mounted in said panel and carrying two rotary members (74), each rotary member (74) being connected to a lever (86) to longitudinally displace the same, said lever being connected for limited relative movement to a rod (90), the rod being connected to a seal assembly (34), spring means (94) normally operating to retain said lever (86) and said rod (90) in a relatively fixed relationship, the displacement of lever (86) causing a displacement of the rod (90), which extends the seal assembly (34) from the panel to contact the track (28) or floor (29).

11. A panel according to claim 10, wherein four lever/rod arrangements are provided, two to act on an upper seal assembly (32) near the ends thereof, and two to act on a lower seal assembly (34) near the ends thereof, the spring means (94) associated with each lever/rod arrangement being adapted to enable each sealing member to adjust to relatively inclined surfaces by permitting relative movement of the rod and lever against the force of the spring.

12. A panel according to claim 10, wherein said actuating member (70) is actuable by rotating it about its axis by inserting a key into the member through an aperture in said edge member (36).

13. A panel according to claim 10, wherein said actuating member (70) is operated by a key insertable in an appropriate aperture in the sheet(s) of material (128, 130) cladding the panel frame (10).

14. A panel according to claim 10, wherein the panel is a door (146) and the actuating member is operated by a door handle.

15. A wall comprising a plurality of panels, each panel having a frame with first and second side walls formed parallel to one another and defining a space therebetween, and an edge member secured to said frame between said first and second sidewalls, said edge member for each panel comprising:

first and second flat exterior planar surfaces formed parallel to one another and defining a space therebetween;

an elongated section having in cross section a first planar flat surface extending from one of said flat exterior planar surfaces of said edge member inwardly into said space and being inclined at an acute angle with respect to said one of said flat exterior planar surfaces, a second planar flat surface extending from the other flat exterior planar surface of said edge member inwardly into said space between said sidewalls and being inclined at an acute angle with respect to said other flat exterior planar surface of said other member, one of said first and second planar surfaces extending inwardly from its adjoining side surface toward said frame and the other said planar flat surface extending inwardly into said space from its adjoining side flat exterior planar surface away from said frame, and a third planar flat surface forming with the planar surface extending away from said frame a male portion and forming with the planar flat surface extending toward said frame a female portion, said male and female portions engaging corresponding male and female portions of a indentical edge member of another panel member to guide said corresponding planar inclined surfaces into closely abutting relationship.

* * * * *